US005156299A

United States Patent [19]

De Caluwe et al.

[11] Patent Number: 5,156,299

[45] Date of Patent: Oct. 20, 1992

[54] PUMP-TYPE DISPENSER PACKAGE WITH FLEXIBLE DISPOSABLE RECHARGE

[75] Inventors: Robert C. J. M. De Caluwe, Londerzeel; Andrë M. G. Jacobs, Zemst, both of Belgium

[73] Assignee: The Procter & Gamble Company, Cincinnati, Ohio

[21] Appl. No.: 670,115

[22] Filed: Mar. 15, 1991

[30] Foreign Application Priority Data

Mar. 19, 1990 [EP] European Pat. Off. ..... 90200645.1

[51] Int. Cl.[5] ..... B67D 5/00

[52] U.S. Cl. ..... 222/82; 222/105; 222/325; 222/383; 220/423; 215/1 C; 383/906

[58] Field of Search ..... 222/82, 91, 92, 94, 222/95, 100, 105, 183, 325, 383, 568; 220/423, 400, 403; 215/1 C; 303/120, 906

[56] References Cited

U.S. PATENT DOCUMENTS

| | | | |
|---|---|---|---|
| Re. 32,383 | 3/1987 | Banks et al. | 53/449 |
| 1,457,895 | 6/1923 | Campanella | 239/373 |
| 2,608,320 | 8/1952 | Harrison, Jr. | 222/95 |
| 2,804,240 | 8/1957 | Anderson | 222/207 |
| 2,859,899 | 11/1958 | Kramer et al. | 222/95 |
| 2,891,700 | 6/1959 | Maynard | 222/92 |
| 3,245,582 | 4/1966 | Roth et al. | 222/4 |
| 3,342,377 | 9/1967 | Peredy | 222/94 |
| 3,421,661 | 1/1969 | Price | 222/94 |
| 3,486,661 | 12/1969 | Friedrich et al. | 222/95 |
| 3,587,937 | 6/1971 | Childs | 222/213 |
| 3,592,365 | 7/1971 | Schwartzman | 222/209 |
| 3,648,903 | 3/1972 | Marchant | 222/212 |
| 3,709,437 | 1/1973 | Wright | 239/343 |
| 3,726,436 | 4/1973 | Despain et al. | 222/213 |
| 3,896,970 | 7/1975 | Laauwe | 222/94 |
| 3,938,707 | 2/1976 | Schmit | 222/91 |
| 3,973,701 | 8/1976 | Gardner | 222/190 |
| 3,989,165 | 11/1976 | Shaw | 222/23 |
| 4,013,195 | 3/1977 | Ferris | 222/95 |
| 4,020,978 | 5/1977 | Szczepanski | 222/209 |
| 4,057,177 | 11/1977 | Laauwe | 222/215 |
| 4,062,475 | 12/1977 | Harris et al. | 222/95 |
| 4,087,023 | 5/1978 | Szczepanski | 222/209 |
| 4,098,434 | 7/1978 | Uhlig | 222/94 |
| 4,138,036 | 2/1979 | Bond | 222/105 |
| 4,139,124 | 2/1979 | Ferrante | 222/110 |
| 4,147,306 | 4/1979 | Bennett | 239/327 |
| 4,154,366 | 5/1979 | Acres | 222/95 |
| 4,159,789 | 7/1979 | Stoody | 222/148 |
| 4,159,790 | 7/1979 | Bailey | 222/211 |

(List continued on next page.)

FOREIGN PATENT DOCUMENTS

| | | | |
|---|---|---|---|
| 961015 | 1/1975 | Canada . | |
| 0182094 | 5/1986 | European Pat. Off. . | |
| 354137 | 2/1990 | European Pat. Off. . | |
| WO82/00780 | 3/1982 | PCT Int'l Appl. . | |
| WO86/00868 | 2/1986 | PCT Int'l Appl. . | |
| 1670 | of 1883 | United Kingdom | 222/183 |
| 1414329 | 11/1975 | United Kingdom | 222/95 |

OTHER PUBLICATIONS

Copending commonly assigned U.S. Patent Application of M. D. Spahni, R. W. Kock C. J. Yeazell and R. C. Johnson, S.N. 483,609, filed Feb. 22, 1990 entitled "Bag-In-Squeeze-Bottle Fluid Dispenser With Means For Resisting Bag Collapse Inserted Therein".

*Primary Examiner*—Andres Kashnikow
*Assistant Examiner*—Philippe Dergshani
*Attorney, Agent, or Firm*—M. E. Hilton; E. K. Linman; K. C. Johnson

[57] ABSTRACT

Pump-type dispenser package with disposable recharge, comprising a rigid outer container equipped with a dispenser head and a flexible disposable recharge, the main walls of which are provided with score lines/folds or embossings acting as product flow channels which ensure that product can be completely emptied, as well as with a connecting piece, which allows easy coupling of the recharge with the dispenser head attached to the rigid outer container in an airtight way.

20 Claims, 3 Drawing Sheets

U.S. PATENT DOCUMENTS

| | | | |
|---|---|---|---|
| 4,265,372 | 5/1981 | Wainberg | 222/82 |
| 4,286,735 | 9/1981 | Sneider | 222/189 |
| 4,295,582 | 10/1981 | Acres | 222/213 |
| 4,322,020 | 3/1982 | Stone | 222/95 |
| 4,340,157 | 7/1982 | Darner | 222/211 |
| 4,387,838 | 6/1983 | Venus, Jr. | 222/95 |
| 4,469,250 | 9/1984 | Evezich | 222/83.5 |
| 4,562,942 | 1/1986 | Diamond | 222/386.5 |
| 4,620,648 | 11/1986 | Schwartzman | 222/490 |
| 4,730,751 | 3/1988 | Mackles et al. | 222/189 |
| 4,785,974 | 11/1988 | Rudick et al. | 222/105 |
| 4,809,884 | 3/1989 | Stackhouse | 222/153 |
| 4,842,165 | 6/1989 | Van Coney | 222/95 |
| 4,865,224 | 9/1989 | Streck | 222/95 |
| 4,936,490 | 6/1990 | Battegazzore | 222/205 |
| 4,949,871 | 8/1990 | Flanner | 222/95 |
| 4,998,990 | 3/1991 | Richter et al. | 222/105 |
| 5,004,123 | 4/1991 | Stoody | 222/94 |
| 5,031,798 | 7/1991 | Wild | 222/105 |
| 5,056,685 | 10/1991 | Wild | 222/105 |

PUMP-TYPE DISPENSER PACKAGE WITH FLEXIBLE DISPOSABLE RECHARGE

TECHNICAL FIELD

The present invention relates to a pump-like dispenser package for flowable products, like liquids, and, more particularly, to a package which consists of an outer, generally rigid container which is reusable and of an inner, flexible disposable container which holds the product and which can be easily replaced.

BACKGROUND OF THE INVENTION

Many flowable products, and more particularly liquids, which are pumped up or sprayed when used, are frequently packed in plastic containers equipped with a dispenser head. Once the contents has been used, the plastic container with dispenser head is thrown away. Such containers with dispenser head are rather expensive and, furthermore, are not biodegradable or easily recyclable, so that it is desirable to find a way to be able to reuse such containers with dispenser head, both from an economical and from an environmental point-of-view, by recharging them with a disposable container holding the product to be dispensed.

U.S. Pat. No. 4,440,317 to Clark, discloses an apparatus whereby a flexible, product-containing bag is received within a two-piece housing which has an inside spring mechanism to engage and exert pressure on the bag once the two pieces of the housing are closed together. A valve mounted to the housing, engages the spout of the bag. Due to the spring mechanism which is necessary to make sure that the product is under pressure and can be sprayed out of the bag, this package is rather expensive to make.

U.S. Pat. No. 4,265,372 of Lawrence Weinberg, discloses a substantially rigid outer container which can be opened so as to receive a disposable flexible pouch containing a commodity, said container being equipped with a dispenser/cuter unit which will puncture the pouch before the product is dispensed. One of the executions (FIG. 13, 14), disclosed in this patent shows dispensing through a spray head, the free end of the suction tube attached to the spray head acting as piercing element for the disposable plastic pouch. Experience has shown that the latter execution does in fact not function very well since, after the spray head has been activated a couple of times and product has been brought up through the suction tube, the opposite main walls of the pouch tend to cling together and product gets trapped in pockets so formed inside the disposable pouch. Furthermore, when the spray head with the suction tube has to be removed from the more or less empty pouch to be pierced into the recharge pouch, there is a high risk of messiness and spilling of product left in the suction tube.

U.S. Pat. No. 3,938,706 to Cohen discloses a fluid or paste dispenser in which use is made of an outer rigid housing in which a flexible disposable product-containing bag is to be inserted. A mechanical means is provided to compress from the bottom the product contained in the disposable bag as dispensing proceeds through a spray head. Here again, the spray head is equipped with a dispensing tube, the free end of which terminates in a piercing element for puncturing the disposable bag. The mechanical means has been provided to make sure that the product continues to egress from the flexible bag and is not trapped due to clinging together of opposite walls of this bag.

In light of the above, a principal object of the present invention is to provide a pump-type dispenser package for flowable products comprising a rigid outer container and a handy disposable recharge.

It is another object of the invention to provide this pump-type dispenser package with a disposable recharge which does not need separate mechanical means to be completely emptied.

It is a further object of the invention to provide a pump-type dispenser package which incorporates means to dispense a product contained in an inner disposable recharge without any risk that said product be spilled at the time the recharge is put into service.

It is still a further object of the invention to provide a pump-type dispenser package which can be efficiently and conveniently used in all package orientations, even inverted, until the contents is virtually completely dispensed.

SUMMARY OF THE INVENTION

The present invention provides a manual pump-type dispenser package with a disposable recharge adapted to house a fluid product, comprising a rigid outer container equipped with a dispenser head having a supply opening, a dispensing opening and means located intermediate the supply opening and the dispensing opening for pumping the fluid product; and a flexible disposable recharge having at least two side walls connected to each other to house the fluid product and having an opening and a connecting piece adapted to sealingly couple the opening of the recharge with the supply opening of the dispenser head, the main walls of which the recharge have means for providing product flow channels which ensure that product within the recharge may flow along the product flow channels to the recharged opening until substantially all of the fluid product is dispensed from the recharge.

The connecting piece and the opening of the flexible disposable recharge may be located on one of the side walls of the flexible disposable recharge and the dispenser package may also include a tube extension connected to the dispenser head. The tube extension cooperates with the connecting piece to provide sealed fluid communication between the recharge opening and the supply opening of the dispenser head. Alternatively, the connecting piece and the opening of the flexible disposable recharge can be located at the top of the flexible disposable recharge and the dispenser package may include a conveying tube depending from the dispenser head. The conveying tube cooperates with the connecting piece to provide sealed communication between the recharge opening and the supply opening of the dispenser head.

The rigid outer container can be made of one piece and have an opening large enough for insertion of the flexible disposable recharge, or can be made of two pieces, the bottom portions of each piece being connected to each other by a hinge, and the top portions of each piece being adapted to be held together by a cap a clip-in feature, alternatively a bayonet device, a screwthread, or other cooperating attachment means is located on each part to permit complete separation and reattachment of the parts. The dispenser head may very well act as a locking mechanism to hold the top part of two halves of the outer rigid container together.

BRIEF DESCRIPTION OF THE DRAWINGS

The following drawings illustrate embodiments of the pump-type dispenser package with flexible disposable recharge according to the invention. Although a spray-head is shown, the invention encompasses other pump-like dispenser heads.

DETAILED DESCRIPTION OF THE DRAWINGS

Figure 1:
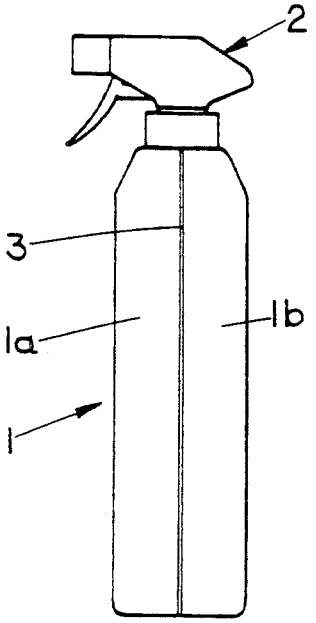
FIG. 1 is a front elevational view of a closed package according to the invention, ready for use.

Referring now to the drawings in detail, wherein like reference numbers indicate the same elements throughout the description, there are illustrated four preferred embodiments of a pump-type dispenser package with flexible disposable recharge according to the present invention.

FIG. 1 manual spray package's outer rigid container (1) topped by spray head (2), junction line (3) showing where the two halves (1*a* and 1*b*) of the outer rigid container meet.

Figure 2:
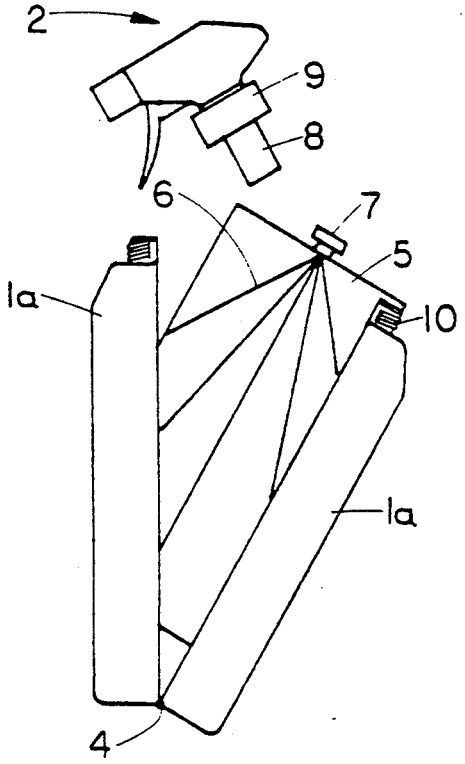
FIG. 2 is a front elevational view of the package of FIG. 1, whereby the two halves of the outer rigid container have been opened after the spray head has been removed, a recharge being inserted.

FIG. 2 shows how spray head (2) has been removed from the outer rigid container which has been opened from the top into halves (1*a* and 1]b) which remain connected to each other by bottom hinge (4). Flexible disposable recharge (5) is being inserted into the container halves. Flexible disposable recharge (5) shows score lines/folds (6). Scorelines/folds (6) extend throughout and are integral with the walls of flexible disposable recharge (5). Flexible disposable recharge (5) is topped by a connecting piece (7) which is to interact with conveying/cutting tube (8) provided at the bottom of spray head (2). Spray head (2) has been removed from outer rigid container (1) by unscrewing cap (9) from container neck (10).

Figure 3:
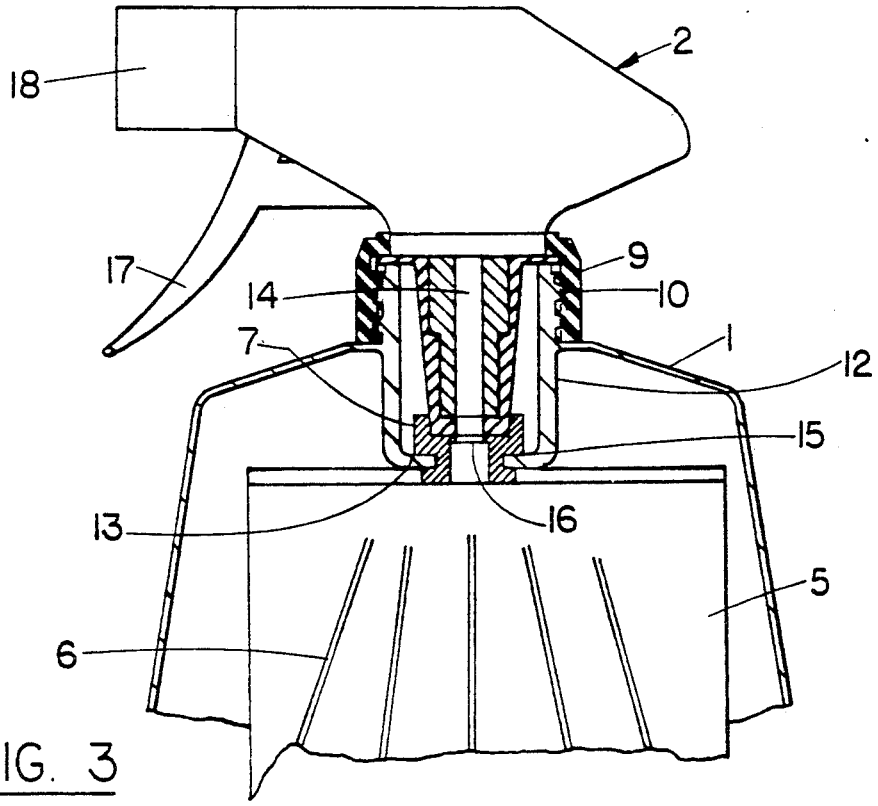
FIG. 3 shows a spray head, the lower portion of which is shown in cut-through, so that the connection of the recharge with the spout can be seen.

The cut-through of the lower portion of spray head (2), top part of container (1) and top part of disposable recharge (5) as shown in FIG. 3, shows how the spray head is connected through the screwthreads on neck (10) of outer rigid container (1) coinciding with internal screwthreads of cap (9). Neck (10) of outer rigid container extends into the container body by tube (12) which ends into inwardly flaring ring (13). This ring (13) engages the connecting piece (7) of disposable recharge (5) when the two halves of said container are brought together into their closing position. Passageway (14) of spray head (2) provides fluid communication from the recharge opening to the supply opening of the dispenser head and is provided with a sharp edge (15) or other means associated with the conveying tube for perforating the membrane (16) at the end facing connecting piece (7) so that, when spray head (2) is screwed onto outer rigid container neck (10), said sharp edge pierces membrane (16) which provides airtight closure of the diameter of connecting piece (7) and consequently of the contents of the flexible disposable recharge (5). As can be seen in FIG. 3, the conveying tube (8) does not extend substantially into disposable recharge (5).

When the spray head (2) is activated by trigger (17) in a conventional way, the product will be discharged from flexible disposable recharge (5) through connecting piece (7), passageway (14) and spray nozzle (18) including a dispensing opening in a conventional way thanks to the provision of score lines/folds (6), channels for product flow remain open to the discharge port even as the opposing walls of the pouch collapse upon themselves.

Figure 4:
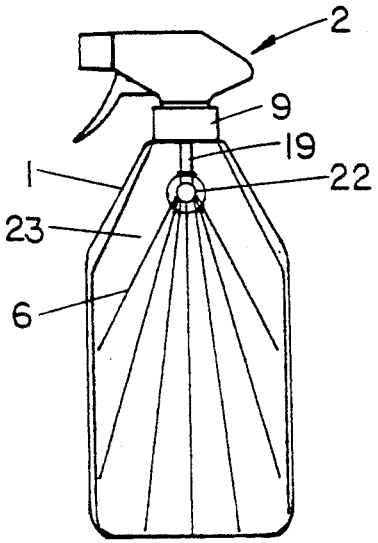
FIG. 4 is a front elevational view of another package according to the invention, the outer rigid container body being shown as transparent so that the positioning of the recharge and its connection with the spray head can be seen for the purpose of the description.
Figure 6A:
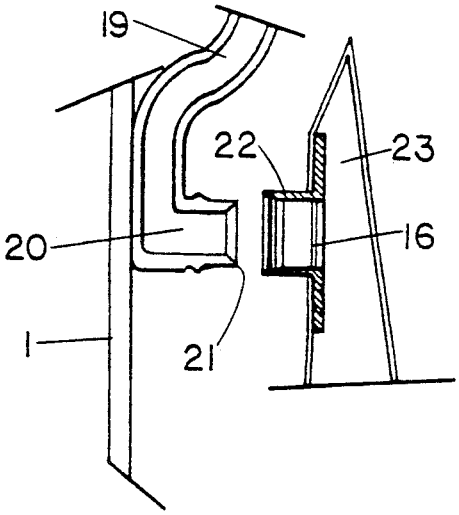
FIGS. 6*a* and 6*b* show in detail and in a partially broken away cut-through, how the recharge of FIGS. 4 and 5 is connected to the spray head.
Figure 5:
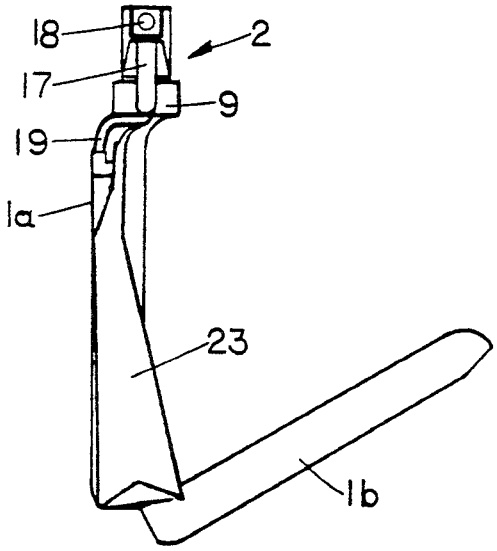
FIG. 5 is a side elevational, partially broken away view of the package shown in FIG. 4, and with one half opened so that the insertion of the recharge can be seen.
Figure 6B:
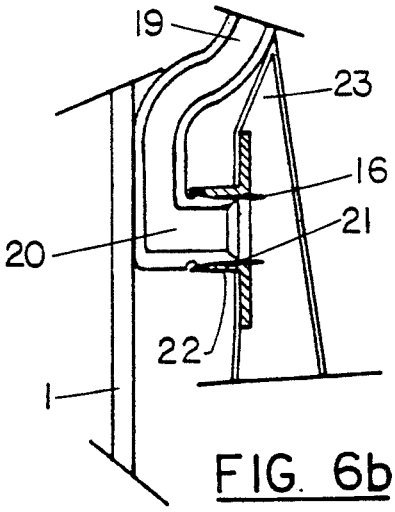

FIGS. 4 to 6 illustrate another preferred embodiment of a pump-type dispenser package with flexible disposable recharge according to the invention, whereby another way of connecting the flexible disposable recharge (23) with a spray head (2) is shown. Spray head (2), attached to rigid outer container (1) by means of screwcap (9), shows an extended curved conveying tube (19) which comes to lie against the inside wall of outside rigid container (1). Said extended conveying tube (19) ends into tube extension (20) which is oriented by 90° away from the inside wall of outer rigid container (1). Said tube extension (20) ends into a sharp edge (21). Connecting piece (22) of flexible disposable recharge (23) is shown in FIG. 6*a* ready to be connected to tube extension (20), whereby sharp edges (21) will perforate membrane (16), whereas FIG. 6*b* shows how the connection has been completed. Here again score lines/folds (6) will ensure proper product flow and virtually complete dispensing of product.

Figure 7:
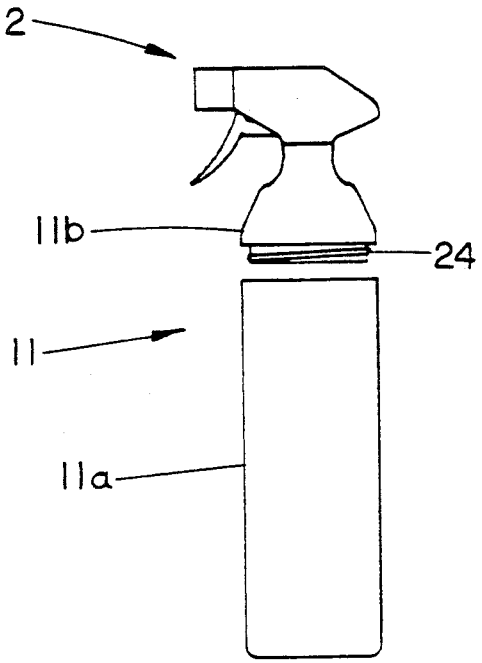
FIG. 7 shows a spray package with disposable recharge whereby the outer rigid container body consists of two pieces joined together below the shoulder of the container.

The outer rigid container body shown in FIG. 7 illustrates how such a container body can be easily separated in two parts (11*a* and 11*b*) so that a flexible disposable recharge can be inserted and attached through a connecting piece as illustrated in the second preferred embodiment. The separation between the two parts of the outer rigid container (11) is to lie under tube extension (20) as illustrated in FIGS. 4 to 6. The two parts of said container can be attached to each other by any conventional means (24) like clipping, hinge, or in the case of cylindrical containers, screwthread or bayonet along a generally horizontal attachment line. The spray head can be attached to container body part (11*b*) by any conventional means.

Figure 8:
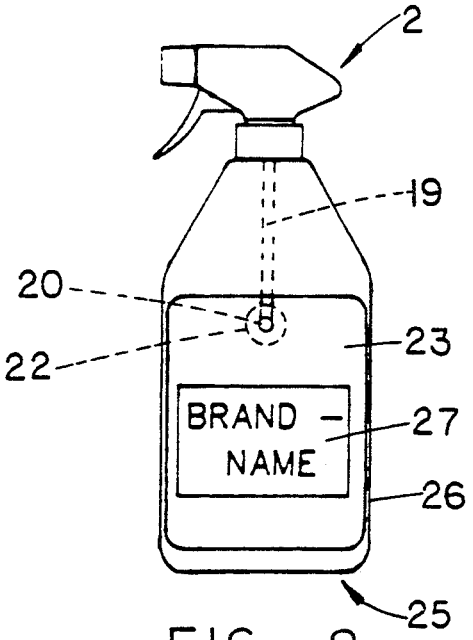
FIG. 8 shows still another execution of the spray package according to the invention, whereby the rigid outer container consists of one piece and shows an opening for insertion of the disposable recharge.

The embodiment illustrated in FIGS. 4 to 6 can be advantageously executed as shown in FIG. 8, with an outer rigid container (25) which is made of one piece ending into a neck (10) onto which the spray head (2) can be attached, said outer rigid container (25) showing an opening (26) in its wall large enough for insertion of the flexible disposable recharge (23) and its attachment, through the connecting piece (22), to tube extension (20). In this execution, opening (26) and tube extension (20) are positioned so that any graphics (27), provided on flexible disposable recharge (23), coincide with opening (26).

As will be evident from the above to the man of the art, the pump-type dispenser package according to the invention can receive a variety of recharges as long as these are made of a flexible material and are equipped with the appropriate connecting devices and anti-cling features. These recharges can be designed to conform to the shape of the outer rigid container when filled, can be of the Doypack ® design which can stand up and is consequently convenient on shelves at the sales point, can be flat-shaped, can be tube-like, etc.

The material of which these recharges are made can be adapted to the contents which has to be dispensed and can consequently be of plastic, metal foil, paper, laminates of any of these materials, etc.

The advantage of complete drainage can be achieved by a variety of geometrical surface modifications of the bag material. Scorelines of various geometries and patterns can produce an acceptable result. Large scale, three dimensional embossing such as described in U.S. Pat. Nos. 4,342,314 and 4,695,422 can also produce the desired results.

It may be desirable to design the shape of the flexible recharge in such a way that its surfaces can be used for e.g. instructions for inserting the recharge in the outer rigid container, usage instructions for the contents, brand names and logos identifying the contents.

The dispenser head can be attached to the outer rigid container by any conventional means like screwthread, bayonet, clipping, as long as it can be easily removed by the user, if necessary, to replace the recharge and easily put back in position to join with the recharge in the proper location. Furthermore, if the outer rigid container is not round and proper positioning of the dispenser head is important, appropriate conventional means can be provided where the dispenser head joins the body of the outer container to ensure proper orientation when put in place.

Various modifications of the described invention will be apparent to those skilled in the art. Examples of several such variations have been mentioned above. Accordingly, the scope of the present invention should be considered in terms of the following claims and is understood not to be limited to details or structures described and shown in the specification and drawings.

What is claimed is:

1. A manual pump-type dispenser package with a disposable recharge adapted to house a fluid product comprising: a rigid outer container including a dispenser head having a supply opening and a conveying tube extending from said supply opening, said dispenser head also having a dispensing opening for discharging the fluid product and means located intermediate the supply opening and the dispensing opening for pumping the fluid product; said dispenser package further comprising a flexible disposable recharge having at least two side walls connected to each other to house the fluid product and having an opening and a connecting piece adapted to sealingly couple the opening of the recharge with the conveying tube of said dispenser head such that said conveying tube of said dispenser head does not extend substantially into said recharge beyond said connecting piece, the side walls of said flexible disposable recharge having means for providing product flow channels extending throughout the recharge such that the fluid product within the recharge may flow along the product flow channels to the recharge opening until substantially all of said fluid product is dispensed from said recharge, said means and said side wall being of a single piece integral construction.

2. Pump-type dispenser package according to claim 1, wherein said product flow channels provided on the main walls of said flexible disposable recharge consist of score lines.

3. Pump-type dispenser package according to claim 1, wherein said product flow channels provided on the main walls of said flexible disposable recharge consist of large scale, three dimensional embossings.

4. Pump-type dispenser package according to claim 1, wherein said connecting piece and said opening of said flexible disposable recharge are located on one of the side walls of said flexible disposable recharge and wherein said dispenser package further comprises a tube extension connected to said dispenser head, said tube extension cooperating with said connecting piece to provide sealed fluid communication between said recharge opening and said supply opening of said dispenser head.

5. Pump-type dispenser package according to claim 1, wherein said connecting piece and said opening of said flexible disposable recharge are located at the top of said flexible disposable recharge and wherein said dispenser package further comprises a conveying tube depending from said dispenser head, said conveying tube cooperating with said connecting piece to provide sealed fluid communication between said recharge opening and said supply opening of said dispenser head.

6. Pump-type dispenser package according to claim 4, wherein said rigid outer container consists of two pieces, the bottom portions of each piece being hingedly connected to the other, the top portions of each piece being adapted to be held together by a cap.

7. Pump-type dispenser package according to claim 4, wherein said rigid outer container consists of two parts, each part having cooperating attachment means which permit complete separation and reattachment of the parts.

8. Pump-type dispenser package according to claim 4, wherein said rigid outer container has an opening through which said flexible disposable recharge can be inserted to permit said connecting piece to be sealingly connected with said conveying tube.

9. Pump-type dispenser package according to claim 2, wherein said connecting piece and said opening of said flexible disposable recharge are located on one of the side walls of said flexible disposable recharge and wherein said dispenser package further comprises a tube extension connected to said dispenser head, said tube extension cooperating with said connecting piece to provide sealed fluid communication between said recharge opening and said supply opening of said dispenser head.

10. Pump-type dispenser package according to claim 3, wherein said connecting piece and said opening of said flexible disposable recharge are located on one of the side walls of said flexible disposable recharge and wherein said dispenser package further comprises a tube extension connected to said dispenser head, said tube extension cooperating with said connecting piece to provide sealed fluid communication between said recharge opening and said supply opening of said dispenser head.

11. Pump-type dispenser package according to claim 2, wherein said connecting piece and said opening of said flexible disposable recharge are located at the top of said flexible disposable recharge and wherein said dispenser package further comprises a conveying tube depending from said dispenser head, said conveying tube cooperating with said connecting piece to provide sealed fluid communication between said recharge opening and said supply opening of said dispenser head.

12. Pump-type dispenser package according to claim 3, wherein said connecting piece and said opening of said flexible disposable recharge are located at the top of said flexible disposable recharge and wherein said dispenser package further comprises a conveying tube depending from said dispenser head, said conveying tube cooperating with said connecting piece to provide sealed fluid communication between said recharge opening and said supply opening of said dispenser head.

13. Pump-type dispenser package according to claim 1, wherein said flexible disposable recharge opening is initially sealed by a membrane and wherein said dispenser package further comprising a means associated with said dispenser head for perforating said membrane.

14. Pump-type dispenser package according to claim 9, wherein said flexible disposable recharge opening is initially sealed by a membrane and wherein said dispenser package further comprises a means associated with said tube extension for perforating said membrane.

15. Pump-type dispenser package according to claim 10, wherein said flexible disposable recharge opening is initially sealed by a membrane and wherein said dispenser package further comprises a means associated with said tube extension for perforating said membrane.

16. Pump-type dispenser package according to claim 11, wherein said flexible disposable recharge opening is initially sealed by a membrane and wherein said dispenser package further comprises a means associated with said conveying tube for perforating said membrane.

17. Pump-type dispenser package according to claim 12, wherein said flexible disposable recharge opening is initially sealed by a membrane and wherein said dispenser package further comprises a means associated with said conveying tube for perforating said membrane.

18. Pump-type dispenser package according to claim 5, wherein said rigid outer container consists of two pieces, the bottom portions of each piece being hingedly connected to the other, the top portions of each piece being adapted to be held together by a cap.

19. Pump-type dispenser package according to claim 5, wherein said rigid outer container consists of two parts, each part having cooperating attachment means which permit complete separation and reattachment of the parts.

20. Pump-type dispenser package according to claim 5, wherein said rigid outer container has an opening through which said flexible disposable recharge can be inserted to permit said connecting piece to be sealingly connected with said conveying tube.

* * * * *